United States Patent [19]

Milner et al.

[11] 4,082,629

[45] Apr. 4, 1978

[54] HYDROMETALLURGICAL PROCESS FOR TREATING METAL SULFIDES CONTAINING LEAD SULFIDE

[75] Inventors: Edward F. G. Milner, Warfield; Ernest G. Parker; Godefridus M. Swinkels, both of Rossland, all of Canada

[73] Assignee: Cominco Ltd., Vancouver, Canada

[21] Appl. No.: 772,630

[22] Filed: Feb. 28, 1977

[51] Int. Cl.[2] ..... C25C 3/34; C22B 1/02; C22B 11/04

[52] U.S. Cl. ..... 204/66; 75/104; 75/114; 75/120; 204/117; 423/94; 423/98

[58] Field of Search ..... 204/66, 114, 117; 75/104, 114, 118 R, 120; 423/94, 98

[56] References Cited

U.S. PATENT DOCUMENTS

| | | | |
|---|---|---|---|
| 1,435,891 | 11/1922 | Christensen | 204/117 |
| 1,441,063 | 1/1923 | Christensen | 204/117 |
| 3,929,597 | 12/1975 | Cottam et al. | 204/66 |
| 3,961,941 | 6/1976 | Baker et al. | 204/66 |
| 4,011,146 | 3/1977 | Coltrinari et al. | 204/117 |

*Primary Examiner*—T. M. Tufariello
*Attorney, Agent, or Firm*—Arne I. Fors

[57] ABSTRACT

A process for the treatment of complex lead sulfide-containing concentrates additionally containing at least one metal of the group consisting of iron, copper, zinc, silver, arsenic, antimony, bismuth and gold which comprises the steps of selectively leaching a concentrate with iron-containing lixiviant for converting lead sulfide in said concentrate to lead chloride and forming a leach residue and a leach solution, subjecting said lead chloride in the leach residue to a two-stage, countercurrent, hot brine leach to dissolve the lead chloride in a brine-leach solution, subjecting the brine leach solution to crystallization by evaporative cooling for the separate recovery of crystallized lead chloride, residual brine and crystallization condensate, and returning said residual brine to said brine leach, subjecting crystallized lead chloride in admixture with sodium chloride to electrolysis in a fused bath for production of lead and evolution of chlorine, absorbing chlorine in a first portion of said leach solution for the generation of ferric chloride-containing solution; and treating a second portion of said leach solution for the recovery of values.

The iron-containing lixiviant comprises an aqueous solution of ferric chloride in a concentration in the range of from 100 to 200 g/l ferric ion or aqueous solutions of ferrous chloride and hydrochloric acid in concentrations in the range of 25 to 160 g/l ferrous chloride and of 60 to 120 g/l hydrochloric acid.

22 Claims, 2 Drawing Figures

HYDROMETALLURGICAL PROCESS FOR TREATING METAL SULFIDES CONTAINING LEAD SULFIDE

BACKGROUND OF THE INVENTION

This invention relates to a process for the recovery of metal values from complex sulfide concentrates and, more particularly, relates to a process for hydrometallurgically treating lead sulfide concentrates for the recovery of lead and other non-ferrous and precious metal values.

Complex sulfide concentrates which may contain lead, zinc, iron, arsenic, antimony, bismuth, copper, silver, gold and the like values have historically been treated in pyrometallurgical processes. Hydrometallurgical processes normally have not been able to cope with such complex compositions either technically or economically. However, rapidly increasing metal prices, higher hygiene standards established for pyrometallurgical processing, and advances in technology have made hydrometallurgical processing of complex sulfide-containing concentrates more attractive.

A number of routes for the hydrometallurgical processing of complex lead sulfide-containing concentrates have been considered, but most have been proved to be either unsuitable for obtaining economical yields of metal values to be recovered or were burdened with prohibitively high costs. Such routes include sulfuric acid pressure leach systems, followed by amine or ammonia extraction, and chloride-based leach systems.

Known prior art on processes using chloride-based systems for the hydrometallurgical processing of lead sulfide-containing concentrates usually disclose a leach wherein an aqueous lixiviant is used which may contain one or more compounds of the group consisting of ferric-, ferrous-, sodium-, magnesium- and calcium-chloride and which may be acidified with either hydrochloric or sulfuric acid. The leach usually is performed hot at atmospheric pressure, lead chloride formed may then be crystallized and subjected to electrolysis for recovery of lead, and the lixiviant recovered and/or regenerated and recycled to the leach.

Typical of these processes are those patented by Niels C. Christensen during the period of 1920 to 1930. For example, according to U.S. Pat. No. 1,435,891, which issued on Nov. 14, 1922, lead-zinc sulfide ore is leached with hot ferric chloride, lead is preferentially dissolved, silver is precipitated and the solution is electrolyzed or cooled and the lead chloride crystallized, melted and electrolyzed. The ferric chloride is regenerated by absorbing chlorine in the residual ferrous chloride solution. The leach residue is treated with sulfuric acid. According to U.S. Pat. No. 1,441,063, which issued Jan. 2, 1923, lead, silver and copper sulfides are leached with a hot chloride lixiviant which comprises sodium-, calcium-, magnesium- or ferrous-chloride as well as ferric-chloride and some hydrochloric acid; silver and copper are cemented from the leach solution and lead is precipitated by electrolysis from aqueous solution or from fused lead chloride. The lixiviant does not act upon pyrite, chalcopyrite and some complex arsenical silver compounds, but does act upon zinc blende to a limited extent.

More recently, a similar process has been disclosed in U.S. Pat. No. 3,929,597, which issued on Dec. 30, 1975. According to this process, lead and silver are produced from sulfides containing lead, silver, zinc and iron by leaching with a ferric salt solution, at 25° - 100° C., separating leach solution from leach residue, leaching the residue with a sodium chloride brine, at 50° - 100° C., cooling the resulting solution to crystallize and separate lead salts, cementing silver from the remaining solution and producing lead by molten lead salt electrolysis. The ferric salt solution is regenerated by contacting the leach solution which contains ferrous salt with chlorine evolved in the electrolysis. A portion of the leach solution is bled off. The residue from the brine leach is treated in a sodium sulfide leach resulting in a sulfide bleed stream and solids, which are treated in a second ferric leach followed by a brine leach for further dissolution of values. A final residue from these second leaches is removed from the process.

Prior art processes, including the processes of the foregoing references, have several limitations. They do not disclose techniques for the separate and economical recovery of metal values contained in complex sulfides, for treating process effluents for the recovery of values in such a manner that pollution is obviated, or for possible integration in a metallurgical plant wherein complex lead containing sulfide concentrates are treated separately from other concentrates. Moreover, the prior art does not disclose techniques and conditions for more selective separation of values in leaching or for careful control of the water mass-balance in the process to enable economic operation.

STATEMENT OF INVENTION

We have now developed a process which substantially overcomes the disadvantages of known prior art processes.

In a preferred embodiment of our invention there is provided a process for the treatment of complex lead sulfide-containing concentrates additionally containing at least one metal of the group consisting of iron, copper, zinc, silver, arsenic, antimony, bismuth and gold which comprises the steps of selectively leaching a concentrate with iron-containing lixiviant for converting lead sulfide in said concentrate to lead chloride to produce a leach residue and a leach solution; subjecting said leach residue to a two-stage, countercurrent, hot brine leach to dissolve lead chloride in a brine-leach solution and to form a brine-leach residue; subjecting the brine-leach solution to crystallization by evaporative cooling to lower the temperature of said solution to the range of from 20° to 30° C. for the separate recovery of crystallized lead chloride, residual brine and crystallization condensate, and returning said residual brine to said brine leach; subjecting crystallized lead chloride in admixture with about 8% by weight of sodium chloride to electrolysis in a fused bath at a temperature in the range of from 410° to 500° C. for production of lead and evolution of chlorine; sequentially washing said brine-leach residue in two or more stages with crystallization condensate to remove lead chloride from said residue; returning condensate from the washing stages to said crystallization and recovering said washed residue; dividing leach solution into two or more portions; absorbing chlorine in a first portion of said leach solution for the generation of ferric chloride-containing solution; and treating a second portion of said leach solution for the recovery of values.

The iron-containing lixiviant comprises ferric chloride in aqueous solution in a concentration in the range of from 100 to 200 g/l ferric ion, and the leaching of concentrate is conducted at a temperature in the range of from 20° to 60° C. and for a period of time of from 2 to 6 hours, whereby substantially all lead is converted to lead chloride and major portions of any zinc, iron, copper, arsenic, antimony, silver and gold remain in the leach residue.

Alternatively, the process of the invention contemplates the use of aqueous solutions of ferrous chloride and hydrochloric acid in concentrations in the range of 25 to 160 g/l ferrous chloride and of 60 to 120 g/l hydrochloric acid for leaching of concentrate, conducted at a temperature above at least about 70° C. with evolution of hydrogen sulfide and for a period of time in the range of 0.5 to 2 hours, whereby substantially all lead is converted to lead chloride, and gold and major portions of zinc, iron, copper, arsenic and antimony remain in the leach residue.

Sulfide ores which may be treated in an integrated metallurgical plant may contain such metals as lead, zinc, copper, iron, cobalt, nickel, arsenic, antimony, bismuth, indium, tin,, tellurium and silver which occur in simple or complex sulfides, and gold. The ores usually are subjected to a preliminary beneficiation to produce concentrates which can be subsequently processed for the economic recovery of values by pyro- and/or hydro-metallurgical techniques. However, total separation of values is never achieved in the preliminary concentrating treatment, with the result that the subsequent metallurgical processes produce further concentrates, intermediates and residues which must be selectively treated to realize full recovery of values. Concentrates that can be treated according to the process of the present invention comprise sulfides containing lead, zinc, copper, iron, arsenic, antimony, bismuth and silver, as well as gold and small amounts of other metals.

We have found that it is important that the leach according to the process of the invention is carried out selectively for lead. While it is desired, therefore, that substantially all lead be converted into lead chloride, the leaching of amounts of zinc, copper, iron, arsenic, bismuth and precious metals is determined by the form in which these metals are present in the concentrate. We have found that by using certain aqueous lixiviants and selected leaching conditions, lead sulfide can be almost completely converted into lead chloride and separated from all other metal values, other metals can be preferentially included in either the leach solution or the leach residue, while some remaining metals will tend to divide between solution and residue.

In selecting lixiviant and leaching conditions, certain other points must be kept in mind. The recovery of metals from leach solutions in the presence of a large amount of iron, i.e., iron contained in spent lixiviant, is difficult to accomplish. Secondly, the conversion of sulfides other than lead sulfide by chloridizing leach reactions will create an imbalance between the masses of chlorine consumed and recycled in the process, since only chlorine from the subsequent electrolysis of lead chloride becomes available for re-use in the lixiviant. Non-selective leaching of sulfides thus leads to an imbalance in chlorine and requires that additional chlorine be supplied to the process. Thirdly, amounts of iron dissolved into leach solutions must eventually be removed in a manner that is both economical and non-polluting.

It is, therefore, an object of the present invention to provide an improved process for the recovery of lead from complex metal sulfide concentrates.

It is another object of the present invention to provide a process for treating complex metal sulfide concentrates for the separate recovery of lead and other metal values in forms which are suitable for further processing of these values.

It is a further object of the present invention to provide a process for treating lead sulfide-containing concentrates for the recovery of metallic lead and of concentrates of other metal values in a form suitable for further processing and recovery of such values.

It is a still further object of the present invention to provide a process comprising selective leaching of metal values from complex metal sulfide concentrates.

It is yet another object of the present invention to provide a process for the recovery of lead from lead sulfide-containing concentrates by the careful balancing of the amount of liquid in the process.

BRIEF DESCRIPTION OF THE DRAWINGS

These and other objects and the manner in which they can be attained will become apparent from the following detailed description of the process of the invention as illustrated in the drawings in which.

DESCRIPTION OF THE PREFERRED EMBODIMENT

Figure 1:
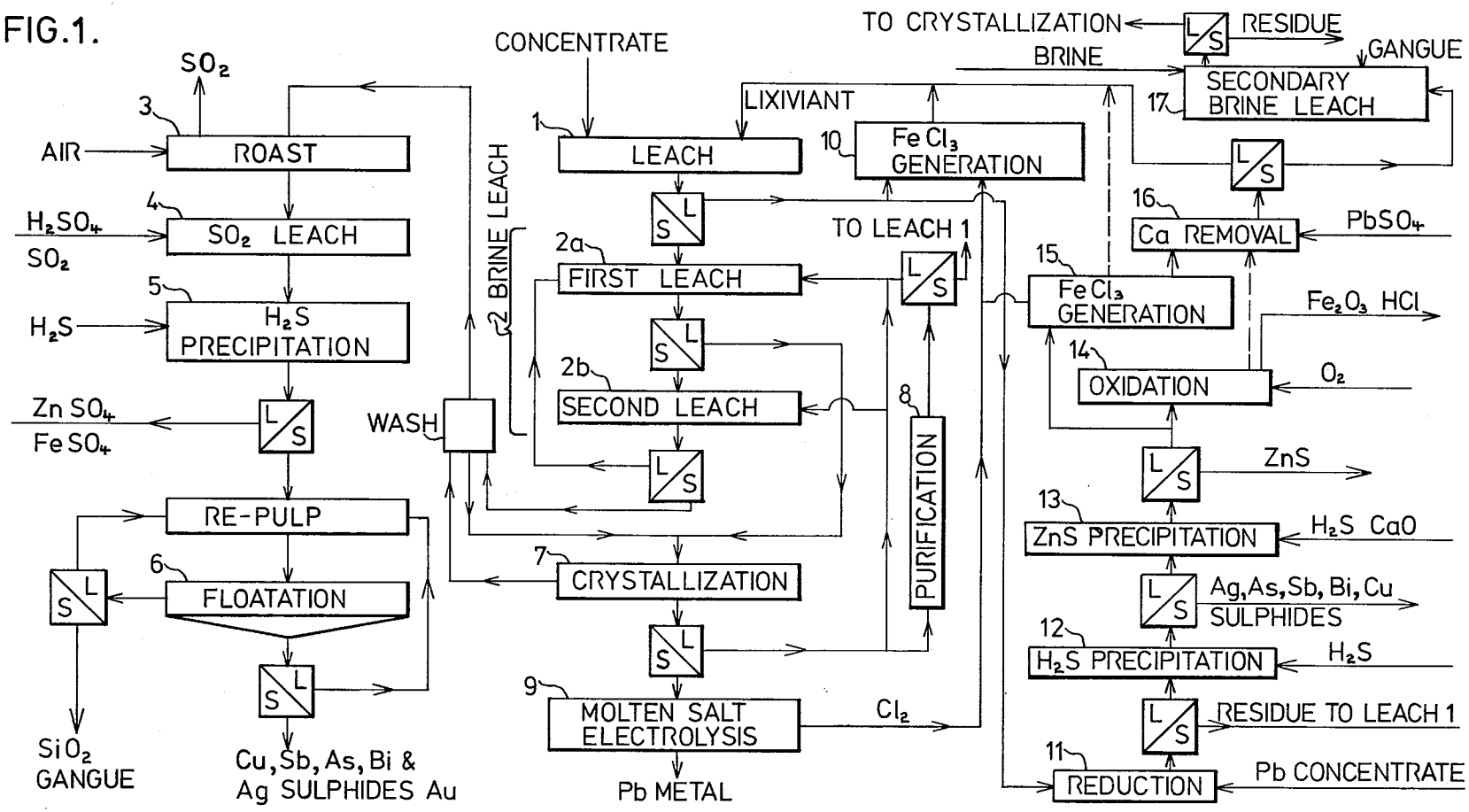
FIG. 1 is a flowsheet of a first embodiment of the process of our invention.

With reference to FIG. 1, concentrate is fed to leach 1 wherein the concentrate is reacted with iron-containing aqueous lixiviant capable of converting lead sulfide to lead chloride. The concentrates may be fed to leach 1 either as received from a concentrator or reground to obtain the required fineness prior to feeding. Particle sizes of 100 mesh or smaller are satisfactory.

The aqueous lixiviant comprises ferric chloride which effectively converts lead sulfide into insoluble lead chloride and elemental sulfur. We have found that the leach is highly selective when carried out at a temperature in the range of 20° to 60° C. for 2 to 6 hours using an amount of ferric chloride in the lixiviant which is sufficient to convert the lead sulfide into lead chloride and a carefully controlled excess of ferric chloride which will be consumed in reactions with other compounds in the feed. The preferred temperature is within the range of from 30° to 50° C.

The lixiviant may contain from 100 to 200 g/l ferric ion, as well as a small amount of hydrochloric acid, such as for example 1 to 10 g/l, to ensure that no readily hydrolyzable metals precipitate. After completion of leach 1, the reaction mixture is subjected to a liquid-solids separation yielding a leach residue and a leach solution.

All liquid-solids separations in the process are carried out using conventional methods and apparatus well known in the art.

The leach residue, which consists of substantially all the lead as lead chloride, substantially all the pyrite, gold, copper, arsenic and antimony, about 80% of the zinc and pyrrhotite, and a portion of the silver and the bismuth, which were present in the original concentrate, as well as elemental sulfur and gangue materials, is washed with water and is subjected to brine leach 2. The lead chloride is extracted in a hot, concentrated aqueous brine and is subsequently separated from the other metal values, sulfur and gangue materials in a brine-leach solution leaching a brine-leach residue.

The aqueous brine may be a concentrated calcium chloride or sodium chloride solution. High brine concentrations yield maximum extraction of lead chloride, but too high concentrations may cause separation of calcium or sodium chloride. We have found that a substantially saturated sodium chloride brine containing from 250 to 320 g/l sodium chloride gives the best results, especially with respect to separation of brine from brine-leach residue and purification of residual brine. If desired, the sodium chloride brine may contain a small amount of calcium chloride to react with any lead sulfate that may be present.

As the brine leach is performed with a substantially saturated brine, which extracts lead chloride almost to the saturation point of lead chloride in the brine, the brine leach and subsequent liquid-solids separation must be carried out to meet four objectives: Substantially all lead chloride must be extracted, the solution must not become saturated in lead chloride, the brine-leach residue must be washed in such a manner that no lead chloride precipitates during washing and the use of excessively large quantities of wash liquid must be avoided.

High concentrations of lead chloride in the brine-leach residue and in the normally associated liquid would result in the precipitation of lead chloride upon dilution with wash liquid. This precipitated lead chloride cannot be removed with moderate amounts of water wash liquid. The use of excessive quantities of wash liquid, including wash liquids for solids obtained in other steps of the brine-leach crystallization circuit, to be described, would upset the essential water mass-balance and would necessitate costly evaporation of excess water.

We have found that by conducting the brine leach in two stages in countercurrent fashion, the four above-named objectives can be met. Using a two-stage countercurrent brine leach, a solution which is substantially saturated with lead chloride can be obtained from the first stage, while solution associated with the solids obtained from the second stage, consequently, has a low lead chloride content and remains well below the saturation point of lead chloride. Washing of the second stage solids can, therefore, be carried out with a small amout of wash liquid without causing precipitation of lead chloride.

Leach residue from leach 1 is leached in the first stage 2*a* of the countercurrent brine leach 2 with liquid from the second stage 2*b* and residual brine which is recirculated from crystallization 7, to be described. After liquid-solids separation of the slurry from first stage 2*a*, the liquid, which constitutes the brine-leach solution, is passed directly to crystallization 7 and the solids are subjected to the second stage 2*b* of the countercurrent leach with residual brine. After liquid-solids separation of the slurry from second stage 2*b*, the liquid is returned to the first stage 2*a* and the solids, which constitute the brine-leach residue, are subjected to sequential washing in two or more stages with hot condensate from crystallization 7. The wash liquid is returned to crystallization 7 and the washed brine-leach residue, substantially free of lead and chloride, may be passed to roast 3.

The use of hot condensate for washing of the brine-leach residue facilitates maintaining the water mass-balance by eliminating the addition of water to the leach-crystallization circuit. The washing of brine-leach residue for the removal of lead chloride is essential if the residue is to be sold or further treated, because contained lead chloride creates problems in subsequent treatment of the residue and so inhibits its saleability. It also represents loss of lead from the present process.

The two-stage, countercurrent brine leach is preferably carried out at temperatures in the range of 80° to 100° C. and is usually completed in a time in the range of 10 to 30 minutes. The leach is kept acidified, i.e., at an "apparent" pH of 0.5 or less, to prevent hydrolysis of bismuth and antimony. The true pH cannot be directly determined because of interference by high salt concentrations. The "apparent" pH was read from a meter standardized against dilute hydrochloric acid solutions of known concentrations and pH.

The brine-leach residue, after washing, may be sold but is preferably treated for recovery of values. Such treatment may be accomplished by a number of methods and we prefer to convert the lead chloride-free, brine-leach residue to calcine by subjecting the residue to a roast 3. If desired, elemental sulfur may be removed from the brine-leach residue prior to conversion to calcine.

In roast 3, any sulfides in the brine-leach residue are converted substantially to oxides and the sulfide sulfur is burned to sulfur dioxide which may be converted into sulfuric acid.

The roast may be advantageously carried out at a temperature in the range of 900° to 1200° C. in a suspension roaster using conventional techniques.

The calcine is fed to sulfur dioxide leach 4 where the calcine is decomposed and dissolved in sulfuric acid with the aid of sulfur dioxide at elevated temperature and pressure. The oxides and ferrites contained in the calcine are dissolved as sulfates. Leach 4 is carried out in an autoclave and the reaction mixture is maintained at a temperature in the range of 70° to 100° C. and under a partial pressure of sulfur dioxide in the range of 1 to 4 $kg/cm^2$ for a period of about 2 hours. Final acid concentration preferably is in the range of 10 to 20 g/l.

The reaction mixture is discharged from the autoclave and treated in hydrogen sulfide precipitation 5 in which the dissolved metal sulfates of copper, arsenic, antimony, bismuth and silver form insoluble sulfides while zinc sulfate and ferrous sulfate remain in solution. The precipitation takes place in one or more enclosed, agitated vessels. Hydrogen sulfide addition is controlled by monitoring the redox potential of the reaction mixture. The temperature is maintained in the range of 20° to 100° C. and the pressure is maintained at about atmospheric pressure. After completion of the precipitation, the reaction mixture is subjected to liquid-solids separation. The liquid fraction, which contains mainly zinc sulfate and ferrous sulfate, may be further treated for the precipitation of iron, for example as iron oxide or jarosite by known methods, and the recovery of a zinc sulfate solution, which may be treated to recover zinc sulfate, or to recover zinc for example by electrolysis. The solids fraction, a small portion of which may be returned to precipitation 5 to improve crystal growth, is repulped and subjected to flotation 6.

Flotation 6 is carried out in a known manner for the separation of sulfides and gold from silica and gangue materials. The flotation concentrate and tailings are each subjected to liquid-solids separation and the liquid fractions are used to re-pulp the solids fraction obtained from precipitation 5. The flotation concentrate solids fraction comprises a sulfide concentrate containing copper, antimony, arsenic, bismuth, silver and gold. This concentrate may be treated further, together with a similar concentrate which is obtained from precipitation 12, to be described, for the separate recovery of its values. The flotation tailings solids fraction which contains mainly silica and gangue minerals as well as some metal values may be discarded or, alternatively, fed to a secondary brine leach 17, to be described.

In crystallization 7, the brine-leach solution obtained from brine leach 2 is cooled to a temperature in the range of 20° to 30° C. whereby substantially pure lead chloride crystallizes. The crystallization of lead chloride preferably is carried out in one or more crystallizers using the evaporative cooling method under reduced pressure whereby lead chloride crystals and residual brine are removed from the crystallizer and whereby a condensate is obtained from the vapors. This condensate is important in the maintaining of a water balance in the process. A portion of the condensate is used in the washing of the brine-leach residue, a second, minor portion is used in the washing of the crystallized lead chloride and a third, minor portion is used in the washing of brine purification residue.

The crystallized lead chloride is separated from the residual brine, washed with condensate and subsequently dried before being fed to molten salt electrolysis 9. The residual brine is returned to first stage 2*a* of brine leach 2. To ensure that a pure lead can be produced, the lead chloride must be of high purity and it has been found necessary to control the impurity content of the brine. To exercise this control, a small portion of the circulating brine is subjected to purification 8 in which the brine is neutralized by addition of an alkaline material such as sodium hydroxide or lime to a pH of from about 7.8 to 10, preferably about 8.5, whereby hydroxides, hydroxy-chlorides or oxychlorides of such metals as zinc, iron, copper, bismuth, arsenic, antimony, lead and silver are precipitated. It is necessary before or during neutralization to sparge an oxidizing gas such as air into the brine to oxidize iron from the ferrous to the ferric state to provide a filterable precipitate. If so desired, the oxidation may be carried out with chlorine prior to neutralization. The precipitate is separated, washed with a minor amount of condensate from crystallization 7 and fed to leach 1. The amount of brine to be treated in purication 8 is usually about 1 to 5% of the total amount of brine.

The dried, pure lead chloride is fed to electrolytic cells for molten salt electrolysis 9. The cells contain a fused mixture consisting preferably of about 92% lead chloride and about 8% sodium chloride which form a eutectic mixture with a melting point of about 410° C. The lead chloride may be fed to the cells directly or may be melted prior to feeding to the cells. In the cells lead chloride decomposes into lead and chlorine. Molten lead is removed from the cells and solidified, while chlorine is taken from the top of the cells and is fed to ferric chloride generation 10. The electrolysis is operated at a temperature in the range of 420° to 500° C. It is understood that other compositions of the fused salt may be used such as eutectic compositions of lead chloride and one or more salts chosen from the group of alkali and alkaline-earth metal chlorides. The operating temperature of the electrolysis depends on the melting temperature of the eutectic composition used. The current efficiency of the electrolysis is 98% or better. The purity of the lead recovered from the cells is 99.9% or better and chlorine recovery is virtually 100%.

The leach solution obtained from leach 1 is divided into two or more portions. In this embodiment the solution is divided into two portions. The first and major portion is contacted with chlorine from electrolysis 9 in generation 10, whereby the ferrous chloride in the solution is oxidized to ferric chloride. The generation proceeds rapidly at temperatures in the range of 25° C. to the boiling point of the solution and may be carried out in at least one absorption tower. The generated ferric chloride-containing solution is returned as the iron-containing lixiviant to leach 1.

The second and minor portion of the leach solution, comprising about 10 to 20% of the total volume, is treated for the recovery of values and for the elimination of unwanted materials from the process in forms which do not create environmental problems. This second and minor portion is first treated in reduction 11, wherein any ferric chloride in the solution is reduced to ferrous chloride. The reductant may be one of a number of suitable compounds but the use of lead sulfide-containing concentrate is preferred. Leach solution and concentrate, containing an amount of lead sulfide at least sufficient to reduce any ferric iron to ferrous iron, are mixed and maintained at a temperature in the range of 20° to 80° C. for a period in the range of 15 minutes to 1 hour. After completion of the reduction, the reaction mixture is separated into a solids and a liquid fraction. The former is fed to leach 1 and the latter to hydrogen sulfide precipitation 12.

In precipitation 12, the solution is treated with hydrogen sulfide to precipitate sulfides of such metals as silver, copper, bismuth, arsenic and antimony. The precipitation is carried out at about atmospheric pressure in a closed vessel and at a temperature in the range of 25° to 90° C., while the addition of hydrogen sulfide is regulated by monitoring the redox potential and maintaining the pH at a value of about 0.5 by the addition of lime, if necessary. The silver, copper, bismuth, arsenic and antimony contained in the solution are substantially completely precipitated and the precipitated sulfides are separated from the liquid. A portion of the sulfides may be recycled to the precipitation 12 to promote crystal growth and the remaining portion is recovered and may be combined with the flotation concentrate solids from flotation 6 and treated for the separate recovery of values.

The liquid obtained after separation from precipitated sulfides is treated with additional hydrogen sulfide and with addition of a neutralizing agent in zinc sulfide precipitation 13. The zinc in the solution is precipitated as substantially pure zinc sulfide at about ambient pressure and at a temperature in the range of 25° to 90° C. while controlling the pH of the reaction mixture at a value of about 1.5 by the addition of lime in the form of a slurry. The zinc sulfide is separated from the liquid and may be recovered as such and further treated or sold, or may be fed to roast 3 for subsequent recovery of zinc in the zinc sulfate-containing solution.

The solution obtained from precipitation 13 now contains mainly ferrous chloride as well as calcium and magnesium chlorides. A portion of this ferrous chloride solution is fed to oxidation 14 for precipitation and removal of excess iron and such undesirable metals as accumulate in the process such as magnesium. In oxidation 14, the solution is treated with oxygen in a pickle liquor furnace at temperatures in the range of 500° to 750° C. whereby metal chlorides are precipitated and converted to oxides and hydrogen chloride is evolved.

The residual solids which are mainly oxides of iron and magnesium are discarded and evolved hydrochloric acid may be absorbed in lixiviant. The remaining portion of the ferrous chloride solution is treated which chlorine in generation 15.

Generation 15 is similar to generation 10 in that ferrous chloride is reacted with chlorine from electrolysis 9 to form ferric chlorides at a temperature in the range of 25° C. to the boiling point of the solution. The generated ferric chloride-containing solution may be combined with generated iron-containing lixiviant from generation 10 as indicated by the broken line, but preferably is fed to calcium removal 16. If desired, solution obtained from precipitation 13 may be fed directly to an oxidation 14, whereby generation 15 is eliminated and wherein ferrous chloride is oxidized to ferric chloride with simultaneous precipitation of ferric oxide. This oxidation is described hereinbelow in detail as step 14 with reference to FIG. 2. Ferric oxide is removed and all or a portion of the ferric chloride solution is fed to calcium removal 16 as indicated by the broken line in FIG. 1.

In calcium removal 16, calcium in the solution is removed, for example, by addition of a stoichiometric amount of sulfuric acid, or iron sulfate. After removal of precipitated calcium sulfate, the solution is fed to leach 1 as iron-containing lixiviant. In a preferred embodiment, we treat the solution with lead sulfate which reacts with calcium chloride in the solution to form calcium sulfate and lead chloride. The lead sulfate may be added to removal 16 as such or in the form of a lead sulfate-containing concentrate or zinc plant leach residue. Zinc plant leach residue is obtained from hydrometallurgical treatment of primary leach residues obtained from roast-leach or hydrometallurgical processes for the recovery of zinc. Such residues contain mainly lead sulfate, silica and gypsum, as well as silver in elemental or combined form. In reacting lead sulfate-containing concentrate or zinc plant leach residue with the calcium chloride and ferric chloride-containing solution, the lead sulfate in the concentrate or the residue is converted to insoluble lead chloride according to $PbSO_4 + CaCl_2 \rightarrow PbCl_2 \downarrow + CaSO_4 \downarrow$ and the silver is converted to a soluble silver chloride complex. Other values also dissolve. The reaction goes to substantial completion in a time in the range of 1 to 4 hours at a temperature in the range of 50° C. to the boiling point of the solution, preferably in the range of 50° to 70° C., at atmospheric pressure. The iron in the solution must be present in the ferric state to ensure that silver sulfide is converted to a soluble silver chloride complex.

The mixture from calcium removal 16 is subjected to liquid-solids separation and the liquid containing ferric chloride is returned as lixiviant to leach 1. The solids may be further treated for the recovery of lead and other values by, for example, subjecting the solids to a secondary hot brine leach 17, which is similar to brine leach 2, to dissolve lead and other values, and to leave a residue which, after separation from solution, may be discarded. As discussed above, the solids contained in the tailings from flotation 6 may also be added to secondary brine leach 17 for ultimate recovery of any residual values contained in those solids. The solution containing lead chloride and other values is fed to a crystallization, not shown, for recovery of lead chloride, or may be fed to crystallization 7.

Figure 2:
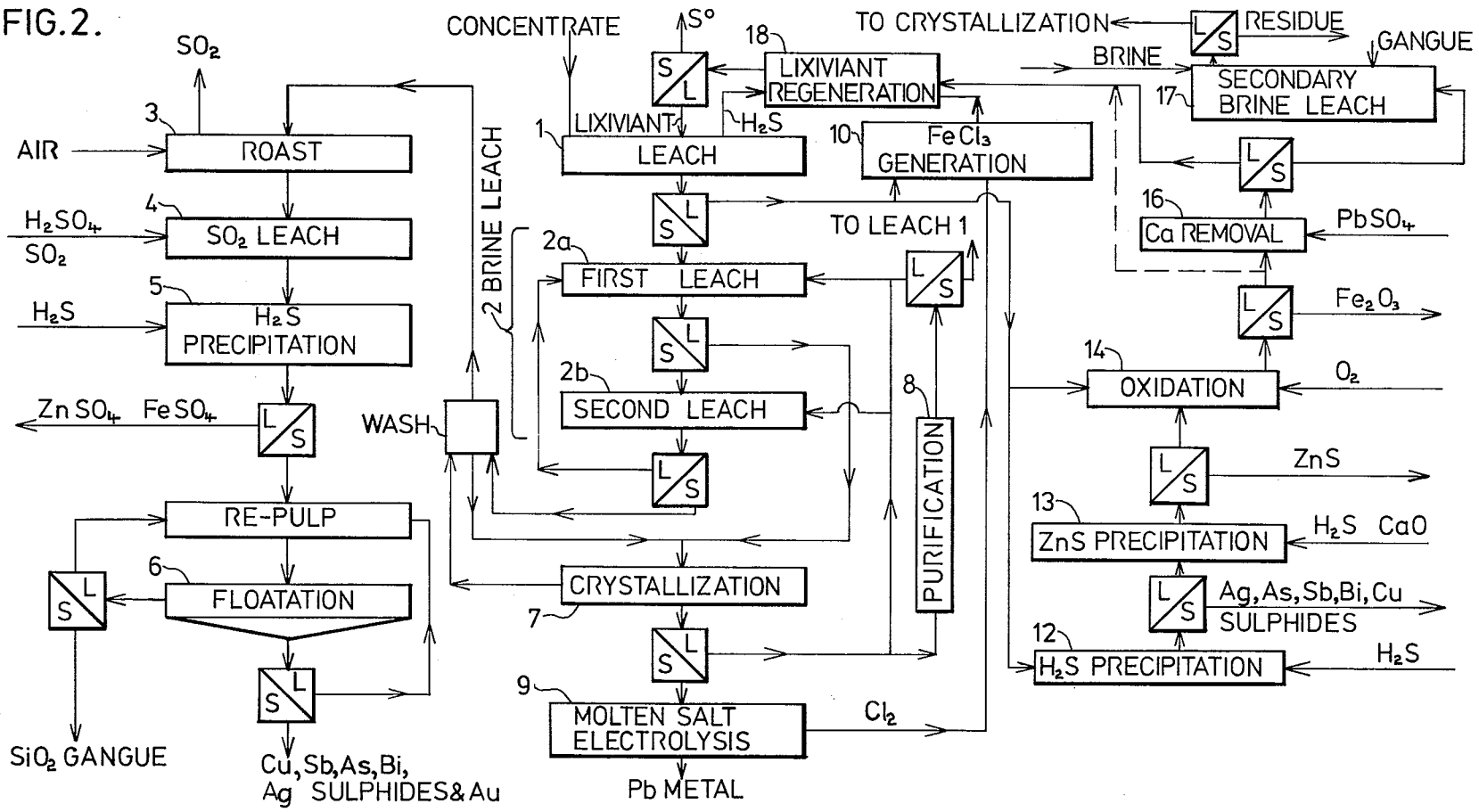
FIG. 2 is a flowsheet of a second embodiment of the process of our invention.

The embodiment of the process of the invention illustrated in FIG. 2 is similar to the embodiment illustrated in FIG. 1, the main differences residing in the use of a different lixiviant in leach 1 and in the regeneration of the lixiviant. In the embodiment of FIG. 2, concentrate as received from the concentrator, or concentrate reground to the desired particle sizes of 100 mesh or smaller, is fed to leach 1 wherein it is contacted with aqueous iron-containing lixiviant capable of converting lead sulfide to lead chloride. The aqueous lixiviant comprises ferrous chloride and hydrochloric acid. The sulfides in the concentrate, upon reacting with the lixiviant, are converted into chlorides and hydrogen sulfide. We have found that the leach can be carried out with a selectivity that is similar to that obtained by leaching with ferric chloride-containing lixiviant as described above the reference to FIG. 1. Lead sulfide in the concentrate is almost quantitatively converted into lead chloride and hydrogen sulfide. A portion of the sulfides of silver, zinc and bismuth, and pyrrhotite react similarly, forming chlorides and hydrogen sulfide, while pyrite, gold and sulfides of copper, arsenic and antimony remain mostly unreacted.

The lixiviant may contain ferrous chloride in an amount in the range of 25 to 160 g/l ferrous ion and hydrochloric acid. With low concentrations of hydrochloric acid in the lixiviant, the amount of liquid to be treated becomes too large to be practical, while with high concentrations, the lixiviant cannot be regenerated to desired high concentrations. The preferred amount of hydrochloric acid in the lixiviant is in the range of 60 to 120 g/l. The leach is carried out at an elevated temperature above at least about 70° C., as desired, under atmospheric or superatmospheric pressure. The leach preferably is carried out in the range of from 90° C. to the boiling point of the reaction mixture under autogenous pressure, in a closed vessel and using an amount of lixiviant sufficient to give a low free acid content in the leach solution without adversely affecting the selectivity of the leach. The leach preferably is carried out countercurrently in two stages with an amount of lixiviant sufficient to give 10 to 20 g/l free acid in the leach solution. Evolved hydrogen sulfide is discharged to lixiviant regeneration 18, to be discussed.

The leaching time is in the range of 0.5 to 2 hours. Reaction mixture is fed to a liquid-solids separation for separation into leach solution and leach residue. As ferrous chloride and hydrogen chloride-containing lixiviant has a higher activity towards certain iron compounds such as pyrrhotite in the concentrate than ferric chloride-containing lixiviant, more iron is leached into the leach solution, while more sulfur is removed as hydrogen sulfide. Consequently, the amount of leach residue is less than that obtained according to the embodiment of the process illustrated in FIG. 1. The larger amount of ferrous chloride in the leach solution does not create any problems with respect to the recovery of metal directly removed from solution in a closed circuit process.

The leach residue is treated using the same methods, conditions and steps, i.e., steps 2 through 9, as discussed above with reference to FIG. 1.

The leach solution is divided into two or more portions. In this embodiment the solution is divided into three portions. A first portion is fed to generation 10 wherein solution is reacted with chlorine from electrolysis 9 to generate ferric chloride from ferrous chloride. This generation 10 is identical to generation 10 illustrated in FIG. 1.

A second portion is treated for the recovery of silver, arsenic, antimony and bismuth in hydrogen sulfide precipitation 12 and subsequently for the recovery of zinc in zinc sulfide precipitation 13. Precipitations 12 and 13 are identical to steps 12 and 13 described with reference to FIG. 1. As no ferric chloride is present in the leach solution, no reduction step is required. The amount of the second portion of leach solution depends on the amounts of silver, arsenic, antimony, bismuth and zinc which are dissolved in leach 1 but is usually in the order of about 10 to 20% of the total volume. The liquid resulting from precipitation 13 is fed to oxidation 14.

The third and remaining portion of the leach solution is fed directly to oxidation 14, together with the liquid resulting from precipitation 13. It is essential that the amount of iron in solutions fed to oxidation 14 is three times the amount of iron which is dissolved into the leach solution obtained from leaching concentrate in leach 1. This requirement determines the amounts of the three portions of the leach solution and ensures the mass-balance of iron in the process. The pertinent reaction is represented by the following equation.

$$3FeCl_2 + \tfrac{3}{4} O_2 \rightarrow 2FeCl_3 + \tfrac{1}{2} Fe_2O_3$$

In oxidation 14, leach solution is reacted with oxygen or an oxygen-bearing gas at elevated temperature and pressure in an autoclave, whereby ferrous chloride is oxidized to ferric chloride with simultaneous precipitation of ferric oxide. The reaction may be carried out continuously at a temperature in the range of 80° to 165° C. under a partial pressure of oxygen in the range of 100 to 200 psi and a retention time in the range of 10 to 120 minutes. In order to obtain non-hydrated ferric oxide which can be easily separated from solution, the preferred temperature range is 135° to 165° C. An easily separable ferric oxide can be obtained with a retention time in the range of 10 to 30 minutes. After completion of the reaction, the reaction mixture is discharged from the autoclave and subjected to a liquid-solids separation.

The solids fraction is removed from the process and the liquid fraction is fed to calcium removal 16 which is identical to removal 16 described with reference to FIG. 1. The solids recovered from this step may be further treated in secondary brine leach 17 as has been described. The liquid from removal 16 is fed to lixiviant regeneration 18. If desired, a portion of the liquid fraction obtained from oxidation 14 may be directly fed to regeneration 18, as indicated by the broken line.

In lixiviant regeneration 18, ferric chloride in solutions obtained from generation 10, oxidation 14 and calcium removal 16 is reacted with hydrogen sulfide evolved in leach 1 according to the following equation:

$$2FeCl_3 + H_2S \rightarrow 2FeCl_2 + 2HCl + S$$

The sulfur in hydrogen sulfide is oxidized to elemental sulfur and ferrous chloride and hydrochloric acid are formed. The reaction is conducted at elevated temperatures in the range of 40° to 160° C. in one or more closed vessels, such as autoclaves or tubular reactors. The reaction mixture is maintained under autogenous pressure when temperatures above the boiling point of the reaction mixture are used. The reaction proceeds rapidly at temperatures in the range of 40° C. to the boiling point of the solution and retention times of about 30 minutes are satisfactory.

After completion of the reaction, the elemental sulfur is separated from the regenerated iron-containing lixiviant. The separation may be carried out separately from the regeneration 18 in a liquid-solids separation when sulfur is formed below its melting point. When sulfur is formed above its melting point, liquid sulfur may be drained directly from the pressure vessel.

The recovered sulfur may be processed into a suitable form or may be processed to produce sulfuric acid. Aqueous, iron-containing lixiviant comprising ferrous chloride and hydrochloric acid is returned to leach 1.

The following examples illustrate the embodiments of the process of the present invention.

EXAMPLE 1

To demonstrate the selective leaching of complex lead sulfide-containing concentrate, 500 g of concentrate having particle sizes of 95% minus 325 mesh and assaying 39.20% lead, 6.35% zinc, 14.50% iron (mostly pyrite), 6.95% copper, 0.27% bismuth and 0.21% silver was leached with 2l of lixiviant containing 112 g/l iron as ferric-chloride at various temperatures for different leaching times. Samples of leach solution were taken at different time intervals and assayed. The distribution of metals in the leach solution represented as percentages of the amounts of metals in the original concentrate was calculated from the assay results. The final residues were analyzed for lead and the conversion of lead to lead chloride was calculated.

The data obtained are presented in Table I. The data presented for iron have been corrected for the amount of iron in the lixiviant. These data show that, by carrying out the leach with ferric chloride at temperatures in the range of 30° to 50° C. using reaction times of up to 4 hours, substantially all lead is converted to lead chloride, substantially all copper and iron remain in the leach residue, between 10 and 20% of the zinc and about 35% of the silver and about 80% of the bismuth are dissolved. Thus, lead can be selectively separated from zinc, iron and copper and a major portion of the silver.

Table I

| Test No. | Temp. °C | Time Min. | Lead Conversion % | Distribution in leach solution calculated as % of metals contained in concentrate | | | | |
|---|---|---|---|---|---|---|---|---|
| | | | | Zn | Fe | Cu | Bi | Ag |
| 1 | 90 | 15 | — | 33 | 17 | 10 | 71 | 57 |
| | | 60 | — | 60 | 33 | 44 | 80 | 84 |
| | | 120 | 99.9 | 79 | 50 | 67 | 92 | 95 |
| 2 | 70 | 15 | — | 28 | <5 | 5 | 65 | 40 |
| | | 60 | — | 37 | <5 | 8 | 69 | 40 |
| | | 120 | 99.8 | 48 | <5 | 15 | 74 | 40 |
| 3 | 53 | 15 | — | 10 | <5 | 2.0 | 55 | 35 |
| | | 60 | — | 20 | <5 | 2.9 | 79 | 35 |
| | | 120 | 99.8 | 25 | <5 | 3.5 | 79 | 35 |
| 4 | 33 | 15 | — | 2.8 | <5 | 1.4 | 47 | 35 |
| | | 60 | — | 5.0 | <5 | 1.7 | 59 | 35 |
| | | 120 | — | 7.5 | <5 | 2.0 | 71 | 35 |
| | | 240 | 99.8 | 10.7 | <5 | 2.3 | 84 | 35 |

EXAMPLE 2

The leach of the previous example was repeated for a lead sulfide concentrate in which iron was present as pyrite, pyrrhotite, chalcopyrite and marmatite and which contained 41.5% lead, 6.3% zinc, 11.7% iron, 4.8% copper, 0.19% bismuth, 0.80% arsenic, 0.58% antimony and 21.1% total sulfur. Concentrate was leached with a ferric chloride-containing lixiviant at different temperatures and retention times and the conversion of lead into lead chloride and the extraction of other metals into the leach solution determined. The test results are presented in Table II. The figures for iron in the Table have been corrected for the amount of iron in the lixiviant. The results show that leaching below 70° C. can be carried out with substantially complete conversion of lead to lead chloride and with a selectivity which extracts minor portions of zinc and iron and very small portions of copper, arsenic and antimony.

Table II

| Test No. | Temp. ° C | Time Min. | % Lead Conversion | % Extraction in Leach Solution Zn | Fe | Cu | Bi | As | Sb |
|---|---|---|---|---|---|---|---|---|---|
| 1 | 30 | 240 | 99.0 | 5 | 13 | 2 | 65 | 2.5 | 2.5 |
| 2 | 70 | 120 | 99.8 | 50 | 19 | 16 | 94 | 8 | 9 |
| 3 | 90 | 120 | 99.9 | 74 | 41 | 60 | 94 | 9 | 10 |

EXAMPLE 3

To demonstrate selective leaching with a ferrous chloride and hydrochloric acid-containing lixiviant, 136 g. of a lead, zinc and iron sulfide-containing concentrate (95% minus 325 mesh) assaying 58.9% lead, 5.6% zinc and 9.7% iron (mostly pyrrhotite) was leached with one liter of lixiviant containing 134 g/l iron as ferrous chloride and varying amounts of hydrochloric acid at various temperatures and leaching times. After separation of leach solution from leach residue, the leach solution was assayed for free hydrochloric acid content and the leach residue was leached with an excess sodium chloride brine at 90° C. for 15 minutes. After separation from brine, the brine-leach residue was assayed for lead, zinc and iron. The distribution of the lead, zinc and iron in the brine-leach residue was calculated as percentages of the amount of these metals present in the original concentrate. The data obtained are presented in Table III.

The data show that lead can be substantially completely converted to lead chloride and separated from the leach residue by a brine leach, and, that by carrying out the leach at temperatures from 90° C. to the boiling point of the solution with residence times between 0.5 and 2 hours and a residual free-acid content in the leach solution of 20 to 40 g/l, about 90% of the zinc can be separated from about 80% of the iron present in the original concentrate. The high extractions of lead and iron and low extraction of zinc are desirable.

Table III

| Test No. | Temp. ° C. | Time Hrs. | Free HCL g/l in lixiviant leach solution Original | Final | Distribution in brine-leach residue calculated as % of metals contained in concentrate Pb | Zn | Fe |
|---|---|---|---|---|---|---|---|
| 1 | 103 | 2 | 68.5 | 19 | 0.1 | 94 | 15 |
| 2 | 103 | 0.5 | 86.5 | 41 | 0.3 | 91 | 20 |
| 3 | 95 | 2 | 86.5 | 39 | 0.6 | 91 | 19 |
| 4 | 95 | 2 | 124.5 | 59 | <0.1 | 42 | 10 |
| 5 | 70 | 2 | 86.5 | 59 | 0.5 | 99 | 74 |

EXAMPLE 4

The leach of the previous example was repeated for a lead sulfide concentrate (95% minus 325 mesh) containing 49.3% lead, 7.6% zinc, 10.3% iron (mainly pyrite), 2% copper, 0.2% bismuth, 1.7% arsenic, a very small amount of antimony and gold and 54 ounces per ton of silver. 196 g. concentrate was leached at 103° C. for 0.5 hour with a lixiviant containing 134 g/l iron as ferrous chloride and 86.5 g/l hydrochloric acid. The leach residue was leached with brine and the brine-leach residue assayed. The distribution of the metals in the brine leach residue as percentages of the amounts present in the concentrate was calculated and the figures are given in Table IV.

Table IV

| Metal Distribution in Brine-Leach Residue Calculated as Percentages of Metals contained in Concentrate | | | | | | | | |
|---|---|---|---|---|---|---|---|---|
| Pb | Zn | Fe | Cu | Bi | As | Sb | Ag | Au |
| 0.1 | 89 | 80 | 99 | 2 | 96 | 98 | 45 | 100 |

The figures presented in Table IV show that lead can be selectively separated from iron, zinc, copper, bismuth, arsenic, antimony, silver and gold by leaching in a ferrous chloride and hydrochloric acid lixiviant followed by a brine leach. The figures further show that substantially all copper, arsenic, antimony and gold are separated in the brine-leach residue together with major portions of the zinc and iron, while substantially all bismuth, minor portions of zinc and iron and about half of the silver are extracted in the leach solution.

It follows from the data presented in Examples 1, 2, 3 and 4 that, by leaching complex lead sulfide-containing concentrates with an iron-containing lixiviant capable of converting lead sulfide into lead chloride under carefully controlled conditions adapted to the composition of each concentrate, lead can be substantially completely converted into lead chloride and other metal values can be selectively extracted into the leach solution or left in the leach residue.

EXAMPLE 5

This example illustrates the treatment of the leach residue in a two-stage countercurrent brine leach followed by crystallization of pure lead chloride, the purification of brine and the washing of brine-leach residue to remove lead chloride and chloride. 100 kg ferric chloride-leach residue containing 50 kg lead as lead chloride was subjected to a first brine leach at 95° C. for 15 minutes with brine containing 300 g/l sodium chloride. The brine comprised 467 l spent brine from the crystallizer containing 7 kg lead and 400 l brine containing 16 kg lead as chloride from the second-stage thickener. First-leach mixture was charged to the first-stage thickener, which yielded a 817 l overflow containing 61 kg lead which was fed to the crystallizer, and an underflow comprising 50 kg solids containing 8 kg lead and 50 l liquid containing 4 kg lead. The underflow was fed to a second brine leach at 95° C. with 400 l spent brine from the crystallizer containing 6 kg lead and 300 g/l sodium chloride. After 15 minutes the second leach mixture was charged to the second thickener from which was obtained 400 l overflow, which was returned to the first brine leach, and an underflow comprising 40 kg solids containing no lead and 50 l liquid containing b 2 kg lead. After further separation, the solids were washed sequentially with three portions of 40 l of hot crystallizer-condensate each. All liquids were combined giving 170 l solution containing 2 kg lead, which was fed to the crystallizer. The washed brine-leach residue comprised 40 kg solids and 40 l liquid containing no lead and less than 0.1% chloride.

In the crystallizer, the solution was cooled to 23° C. by evaporative cooling yielding 50 kg lead as pure lead chloride (99.8%), 867 l residual brine containing 13 kg lead which was returned to the first- and second-stage brine leaches, and 120 l hot condensate, which was used to wash lead chloride and brine from the final brine-leach residue.

The presented data clearly show that proper washing yields a substantially lead-free and chloride-free residue and that no water is necessary to perform the washing over and above the amount obtained in the evaporative crystallization of lead chloride.

EXAMPLE 6

This example illustrates that brine solutions can be effectively purified and that a sodium chloride brine can be more effectively purified than a calcium chloride brine. One liter spent brine from the crystallizer was neutralized at about 70° C. with lime to a pH of about 8 while air was bubbled through the solution. The resulting purified brine was separated from precipitated solids. Test results are shown in Table V.

Table V

| Brine Sample | pH | Temp. °C | Lime g | Brine Assay in mg/l Pb | Zn | Fe | Cu | Bi | Sb | As | Ag |
|---|---|---|---|---|---|---|---|---|---|---|---|
| $CaCl_2$ Brine | | | | | | | | | | | |
| Unpurified | 0.5 | — | — | 30000 | 780 | 3400 | 210 | 260 | 40 | 36 | 215 |
| Purified | 8.0 | 69 | 4.9 | 2000 | 132 | 18 | 2 | 30 | 0.1 | 0.5 | 180 |
| NaCl Brine | | | | | | | | | | | |
| Unpurified | 0.5 | — | — | 20000 | 900 | 4800 | 240 | 270 | 49 | 40 | 240 |
| Purified | 8.5 | 68 | 17.0 | 225 | 2 | 4 | <1 | 6 | <0.1 | <0.1 | 2 |

EXAMPLE 7

In this example it is shown that lead, which meets the ASTM specification for corroding lead, can be produced electrolytically from a molten salt eutectic mixture containing 92% by weight of lead chloride and 8% by weight of sodium chloride.

Lead chloride obtained from the test of Example 5 having a purity of 99.8% was used to make the eutectic mixture. The cell was a ceramic-lined vessel with graphite electrodes spaced at 40 mm to which a current of 50A and a voltage of 3.5V were applied giving a current density of 128A/dm$^2$. The cell was operated at a temperature of 480° C. and 200 g lead was produced per hour with a current efficiency of 99%. The lead was spectrographically analyzed and found to contain less than 30 parts per million of total impurities, i.e., Al, Sb, As, Bi, Cu, Fe, Ag, Sn, Zn, Si, Ni and Ca.

EXAMPLE 8

To demonstrate that the iron balance can be maintained in the process, wherein a lead sulfide containing concentrate is leached with a ferrous chloride and hydrochloric acid-containing lixiviant, excess iron is rejected by oxidation of ferrous chloride to ferric oxide with simultaneous production of ferric chloride, and lixiviant is regenerated by reaction of ferric chloride with hydrogen sulfide, 100 kg of a lead concentrate containing 50% lead and 10% iron is treated with 300 l lixiviant containing 40.2 kg iron as ferrous chloride (134 g/l iron) and 26.4 kg hydrochloric acid (88 g/l) at 103° C. for 1 hour. All of the lead and 50% of the iron are converted to chlorides. The leach residue, containing 50 kg lead and 5 kg iron, is fed to the brine leach, while 300 l leach solution, containing 45.2 kg iron, is split in three portions. 200.4 l containing 30.2 kg iron is treated with chlorine obtained from electrolysis of lead chloride, yielding 200.4 l ferric chloride solution containing 30.2 kg iron. 10 l leach solution containing 1.5 kg iron is treated for removal of values leaving the same amount of solution and iron for treating in the oxidation. 89.6 l leach solution containing 13.5 kg iron is fed directly to the oxidation. The total amount of iron fed to the oxidation is 15 kg, i.e., three times the amount of iron dissolved in the leach solution.

In the oxidation, the solution is oxidized at 160° C. for 20 minutes under a partial pressure of oxygen of 7 atmosphere. The reaction equation is as follows:

$$3\ FeCl_2 + \tfrac{3}{4}\ O_2 \rightarrow 2FeCl_3 + \tfrac{1}{2}\ Fe_2O_3$$

As seen from this equation, one third of the iron is precipitated as ferric oxide which requires that the solution fed to the oxidation contains an amount of iron which is three times as large. Thus, in order to maintain the iron mass-balance in the process, the solution treated in the oxidation must contain three times the amount of iron dissolved from the concentrate in the leach.

The iron oxide is removed from the oxidation reaction mixture leaving 99.6 l solution containing 10 kg iron as ferric chloride. This solution is fed to the lixiviant regeneration, together with the 200.4 l solution containing 30.2 kg iron obtained from the chlorine treatment, wherein the solution is treated with hydrogen sulfide, obtained from the leach of concentrate, at a temperature of 80° C. for 30 minutes yielding elemental sulfur and 300 l regenerated lixiviant containing 40.2 kg iron as ferrous chloride.

EXAMPLE 9

This example illustrates the treatment of zinc plant leach-residue, calcium removal and secondary brine leach. 155 g of a zinc plant leach residue containing lead, zinc and calcium sulfate as well as silver was leached in one liter of a solution containing 100 g/l ferric ion as ferric chloride and 11 g/l calcium ion at 100° C. for 4 hours. After liquid-solids separation, one liter leach solution was obtained. The leach residue was leached in one liter brine containing 250 g/l sodium chloride and 50 g/l calcium chloride at 95° C. for 15 minutes. Liquid-solids separation of the brine-leach reaction mixture yielded one liter brine-leach solution and 80 g brine-leach residue. The compositions of solids and liquids are given in Table VI.

Table VI

| Material | Unit | Composition Pb | Ca | Zn | Ag | $S(SO_4)$ |
|---|---|---|---|---|---|---|
| Zinc-Plant Leach Residue | % | 36.8 | 5.75 | 2.6 | 4.4 | 10.5 |
| | | | | | (oz/t) | |
| | g | 57.0 | 8.9 | 4.0 | 0.023 | 16.3 |
| Leach Solution | g/l | 4.9 | 1.5 | 3.7 | 0.016 | 2.2 |
| Brine-Leach Solution | g/l | 52.0 | 18.0 | trace | 0.005 | trace |
| Brine-Leach Residue | % | 0.3 | 23.0 | 0.35 | 0.7 | 17.6 |
| | | | | | (oz/t) | |
| | g | 0.25 | 18.4 | 0.3 | 0.002 | 14.1 |

It is evident from the figures presented in Table VI that lead, silver and zinc values contained in zinc plant leach residue can be effectively recovered, the lead in the brine-leach solution and the silver and zinc mainly in the leach solution. The calcium present in the ferric chloride-containing solution is effectively removed.

What we claim as new and desire to protect by Letters Patent of the United States is:

1. A process for the treatment of complex lead sulfide-containing concentrates additionally containing at least one metal of the group consisting of iron, copper, zinc, silver, arsenic, antimony, bismuth and gold which comprises the steps of:

(1) selectively leaching concentrate with an iron-containing lixiviant for converting lead sulfide in said concentrate to lead chloride to produce a leach residue and a leach solution;

(2) subjecting said leach residue to a two-stage, countercurrent, hot brine leach to dissolve lead chloride in a brine-leach solution and to form a brine-leach residue;

(3) subjecting the brine-leach solution to crystallization by evaporative cooling to lower the temperature of the said solution to the range of 20° to 30° C. for the separate recovery of crystallized lead chloride, residual brine and crystallization condensate, and returning said residual brine to the brine leach of step (2);

(4) subjecting crystallized lead chloride in admixture with about 8% by weight of sodium chloride to electrolysis in a fused bath at a temperature in the range of 410° to 500° C. for production of lead and evolution of chlorine;

(5) sequentially washing the brine-leach residue from step (2) in two or more stages with crystallization condensate to remove lead chloride from said residue, returning condensate from said washing stages to step (3) and recovering said washed residue;

(6) dividing leach solution from step (1) into two or more portions;

(7) absorbing chlorine in a first portion of the leach solution from step (1) for the generation of ferric chloride-containing solution; and (8) treating a second portion of leach solution for the recovery of contained values.

2. A process as claimed in claim 1, wherein said iron-containing lixiviant comprises ferric chloride in aqueous solution in a concentration in the range of 100 to 200 g/l ferric ion and wherein said leaching of concentrate is conducted at a temperature in the range of 20° to 60° C. and for a period of time in the range of 2 to 6 hours, whereby substantially all lead is converted to lead chloride and major portions of any zinc, iron, copper, arsenic, antimony, silver and gold remain in the leach residue.

3. A process as claimed in claim 1, wherein said iron-containing lixiviant comprises aqueous solutions of ferrous chloride and hydrochloric acid in concentrations in the range of 25 to 160 g/l ferrous chloride and of 60 to 120 g/l hydrochloric acid and wherein said leaching of concentrate is conducted at a temperature above at least about 70° C. with evolution of hydrogen sulfide and for a period of time in the range of 0.5 to 2 hours, whereby substantially all lead is converted to lead chloride, and gold and major portions of zinc, iron, copper, arsenic and antimony remain in the leach residue.

4. A process as claimed in claim 3, wherein said leaching is carried out at a temperature in the range of 90° C. to the boiling point of the reaction mixture under autogenous pressure.

5. A process as claimed in claim 1, wherein said two-stage countercurrent hot brine leach is conducted with a substantially saturated brine containing 250 to 320 g/l sodium chloride at a temperature in the range of 80° to 100° C. and apparent pH of not more than 0.5, and wherein said leach comprises the steps of:

(1) passing lead chloride containing leach residue, residual brine and liquid from a second stage to a first stage for extraction of a major portion of lead chloride in a brine-leach solution;

(2) separating solids from said brine-leach solution;

(3) treating the brine-leach solution for crystallization of lead chloride by evaporative cooling;

(4) separating crystallized lead chloride from residual brine;

(5) passing separated solids and residual brine to a second stage for extraction of a minor portion of lead chloride;

(6) separating liquid from brine-leach residue;

(7) returning separated liquid to the first stage;

(8) sequentially washing the brine-leach residue in two or more stages with crystallization condensate to substantially remove lead chloride from said residue; and (9) returning said crystallization condensate to the crystallization.

6. A process as claimed in claim 1, wherein the washed brine-leach residue is further treated according to the process comprising the steps of:

(1) roasting said brine-leach residue to form sulfur dioxide and calcine;

(2) subjecting said calcine to a pressure leach at elevated temperature with sulfur dioxide and a sulfuric acid-containing solution to produce a leach slurry;

(3) treating said slurry with hydrogen sulfide;

(4) separating liquid from solids in the treated slurry and removing liquid containing zinc sulfate; and (5) subjecting the solids from the treated slurry to flotation for the removal of silica and gangue materials and recovering a concentrate containing at least one metal of the group copper, silver, arsenic, antimony, bismuth and gold.

7. A process as claimed in claim 6, wherein said pressure leach of calcine is conducted at a temperature in the range of 70° to 100° C. and under a partial pressure of sulfur dioxide in the range of 1 to 4 kg/cm$^2$.

8. A process as claimed in claim 1, wherein a portion of the brine returned from the crystallization to the brine leach is purified by neutralizing said portion to a pH in the range of 7.8 to 10.0 thereby forming a precipitate of metal compounds separating precipitate from the purified brine portion and feeding said precipitate to said concentrate leaching step.

9. A process as claimed in claim 1, wherein treatment of the second portion of the leach solution comprises the steps of:

(1) treating said solution with hydrogen sulfide at 25° - 70° C. and atmospheric pressure for the formation of a precipitate containing at least one sulfide of the group of sulfides of copper, silver, arsenic, antimony and bismuth and recovering said precipitate from solution;

(2) treating solution from step (1) with lime and an additional amount of hydrogen sulfide to precipitate zinc sulfide at 25° - 90° C., at atmospheric pressure and at a pH of 1.5 and recovering said zinc sulfide from solution;

(3) treating at least a portion of solution from step (2) with oxygen at elevated temperature for precipitation and subsequent removal of excess iron from the process as ferric oxide and oxidizing at least a portion of ferrous chloride contained in solution from step (2) to ferric chloride to generate ferric chloride-containing solution; and (4) removing calcium from solution containing ferric chloride by addition of a material chosen from iron sulfate, sulfuric acid, lead sulfate and lead sulfate-containing material for the formation of a residue comprising calcium sulfate and lead chloride, and residual ferric chloride solution.

10. A process as claimed in claim 9, wherein ferric chloride contained in said second portion of the leach solution is reduced prior to treatment with hydrogen sulfide by the addition of lead sulfide-containing concentrate at a temperature in the range of 20° to 80° C. for a period of time in the range of 15 minutes to 1 hour and wherein residue obtained from the reduction is returned to the leaching of concentrate.

11. A process as claimed in claim 9, wherein said treatment with oxygen is carried out at a temperature in the range of 500° to 750° C. and wherein oxidation of ferrous chloride to ferric chloride in at least a portion of solution is carried out by absorbing chlorine in the solution at a temperature in the range of 25° C. to the boiling point of the solution.

12. A process as claimed in claim 9, wherein said treatment with oxygen is carried out at a temperature in the range of 80° to 165° C., at a partial pressure of oxygen in the range of 100 to 200 psi and with a retention time in the range of 15 to 120 minutes and wherein said precipitation of excess iron as iron oxide and said oxidation of ferrous chloride to ferric chloride to generate ferric chloride-containing solution occur simultaneously.

13. A process as claimed in claim 12, wherein said temperature is in the range of 135° to 165° C. and said retention time is in the range of 15 to 30 minutes.

14. A process as claimed in claim 1, wherein said leach solution from step (1) in claim 1 is divided into three portions.

15. A process as claimed in claim 14, absorbing chlorine in a first portion of the leach solution for the generation of ferric chloride-containing solution, treating a second portion of the leach solution for the recovery of contained values and treating the third portion of the leach solution with oxygen at elevated temperature for precipitation and subsequent removal of excess iron from the process as ferric oxide and oxidizing at least a portion of ferrous chloride in said third portion to ferric chloride to generate ferric chloride-containing solution.

16. A process as claimed in claim 15, wherein said treatment with oxygen is carried out at a temperature in the range of 80° to 165° C., at a partial pressure of oxygen in the range of 100 to 200 psi and with a retention time in the range of 15 to 120 minutes and wherein said precipitation of excess iron as iron oxide and said oxidation of ferrous chloride to ferric chloride to generate ferric chloride-containing solution occur simultaneously.

17. A process as claimed in claim 9, wherein the removing of calcium from solution containing ferric chloride is carried out by adding lead sulfate, maintaining the temperature in the range of 50° C. to the boiling point of the solution at atmospheric pressure for a period of time in the range of 1 to 4 hours and removing residue comprising calcium sulfate and lead chloride from residual solution and wherein said residue is treated for the recovery of lead chloride.

18. A process as claimed in claim 9, wherein the removing of calcium from solution containing ferric chloride is carried out by adding lead sulfate contained in zinc plant leach residue, maintaining the temperature in the range of 50° to 70° C., removing residue comprising calcium sulfate and lead chloride from residual solution and wherein said residue is leached in sodium chloride containing brine at a temperature in the range of 80° to 100° C. and the resulting lead chloride-containing solution is fed to step (3) of claim 1.

19. A process as claimed in claim 9, wherein said residual solution is returned as lixiviant to the leaching of concentrate.

20. A process as claimed in claim 1, wherein generated ferric chloride-containing solution of step (7) of claim 1 is returned as lixiviant to the leaching of concentrate.

21. A process as claimed in claim 3, wherein ferric chloride-containing solution is reacted at a temperature in the range of 40° to 160° C. under autogenous pressure with hydrogen sulfide evolved in the leaching of concentrate for the formation of elemental sulfur and regeneration of iron-containing lixiviant comprising ferrous chloride and hydrogen chloride, wherein said elemental sulfur is recovered and wherein said lixiviant is fed to the leaching of concentrate.

22. A process as claimed in claim 9, wherein ferric chloride-containing solution is reacted at a temperature in the range of 40° to 160° C. under autogenous pressure with hydrogen sulfide evolved in the leaching of concentrate for the formation of elemental sulfur and regeneration of iron-containing lixiviant comprising ferrous chloride and hydrogen chloride, wherein said elemental sulfur is recovered, wherein said lixiviant is fed to the leaching of concentrate and wherein said ferric chloride-containing solution comprises at least one of the solutions from the solutions obtained from the ferric chloride generation, oxidation and calcium removal.

* * * * *